US006216629B1

(12) United States Patent
Straub

(10) Patent No.: US 6,216,629 B1
(45) Date of Patent: Apr. 17, 2001

(54) MARKER FOR WARNING OF RECREATIONAL POOL DEPTH

(76) Inventor: Curt Straub, P.O. Box 9254, Shawnee Mission, KS (US) 66201-1854

( * ) Notice: Subject to any disclaimer, the term of this patent is extended or adjusted under 35 U.S.C. 154(b) by 0 days.

(21) Appl. No.: 09/426,972

(22) Filed: Oct. 26, 1999

(51) Int. Cl.[7] ..... G09F 7/00

(52) U.S. Cl. ..... 116/209; 116/200; 40/608; 4/496

(58) Field of Search ..... 116/63 P, 63 R, 116/63 L, 209, 173, 174, 175, 227, 200; 33/511, 512; 4/496, 504, 506, 488, 608; 40/584, 606, 607, 612

(56) References Cited

U.S. PATENT DOCUMENTS

D. 345,702 * 4/1994 Hilpmann ..... D10/71
3,517,905 * 6/1970 Nestegard ..... 40/606
4,123,183 * 10/1978 Ryan ..... 404/10
4,249,357 * 2/1981 Cornou ..... 116/63 R
4,608,773 * 9/1986 White ..... 40/606

* cited by examiner

*Primary Examiner*—Andrew H. Hirshfeld
(74) *Attorney, Agent, or Firm*—Mark Manley

(57) ABSTRACT

A system of stanchions used to warn about the depth of a swimming pool. The stanchions stand upright and carry a "no dive" warning message about the depth of the pool. Each stanchion can have a flexible base that allows it to flex from a generally vertical position to a horizontal position if someone bumps into it. The stanchions can be read from any direction of approach. The height of the stanchion indicates the depth of the bottom of the pool adjacent to where it is standing.

6 Claims, 4 Drawing Sheets

TOP VIEW

MARKER FOR WARNING OF RECREATIONAL POOL DEPTH

BACKGROUND OF THE INVENTION

1. Field of the Invention

The present invention is related to a system for preventing accidents caused by people diving into shallow water. More particularly, the present invention is directed to a system of swimming pool depth markers. The depth markers stand upright and indicate the depth of the adjacent pool with a standard insignia and by the height of the markers themselves.

2. Description of the Related Art

One of the most common swimming accidents in pools occurs when people dive into shallow water and hit their head on the bottom of the pool. Almost all diving accidents occur when a person dives from the deck of the pool into the shallow end. These accidents often result in severe injury to the head and/or neck. It is common to mark the depth of the water at a particular point on the deck surrounding the pool. This is done adjacent to the depth indicated. The problem with this practice is that the numbers or words are not easily visible to a person running up to dive in the pool. The depth and warning signs are typically written flat on the surface of the deck. Warnings thus written, because of the angle, are not clearly visible to an observer depending upon the approach.

U.S. Pat. No. 3,990,167 to Whitten shows an example of a depth marking system for a swimming pool. In the Written Patent the depth marking, which is in the gutter of the pool, would be invisible to a person running up to dive in the pool until too late.

U.S. Pat. No. 3,956,779 to Jewett shows a system of baffles designed in part to safeguard divers by cushioning the bottom of the pool. This patent addresses the same problem as applicant but uses a very different method. Jewett stresses reducing the impact of the diving accident rather than preventing the accident altogether. The system of Jewett would be difficult to install and is not in widespread use if it is used at all.

U.S. Pat. No. 5,168,584 to Peebles discloses another method of preventing pool accidents. In this patent a perimeter barrier totally prevents access to the pool. This is intended to prevent drowning accidents where a small child might fall into an unattended pool.

None of these prior art patents discloses a device that will prevent diving accidents by providing a prominent warning about depth.

SUMMARY OF THE INVENTION

Accordingly it is the object of the present invention to provide a swimming pool depth marking system that will reduce diving related injuries by providing a more clearly visible warning to persons approaching the swimming pool.

It is a further object of the present invention to provide a system of pool depth marking that will warn would be divers of the depth hazard irregardless of their angle of approach to the pool edge.

It is a further object of the present invention to provide a sign the height of which is indicative of the pool depth adjacent to the sign.

It is a further object of the present invention to provide a depth sign that will easily flex out of the way if bumped against but that will return automatically to its original position.

The invention comprises a series of signs that will be located around the shallow end of the pool. The upright standing signs will be easily visible to someone approaching the pool. The signs will have three faces so that the warning is visible from any angle of approach including someone who swims up to the edge and climbs out.

The semi-rigid signs will be mounted on a base so that they will deflect if bumped into, but then they will return back to their original position.

The signs are intended for use in the pool industry, typical applications would occur around public and hotel and motel swimming pools although they can be used around virtually any swimming pool. These signs could also be used along docks or anywhere where diving accidents are known to occur. The signs will carry standard size lettering and graphics to indicate depth and warn of no diving.

Other objects and advantages of the present invention will become apparent from the following description taken in connection with the accompanying drawings, wherein is set forth by way of example, the preferred embodiments of the present invention and the best mode currently known to the inventor for carrying out the invention.

DETAILED DESCRIPTION OF THE PREFERRED EMBODIMENTS

Figure 1:
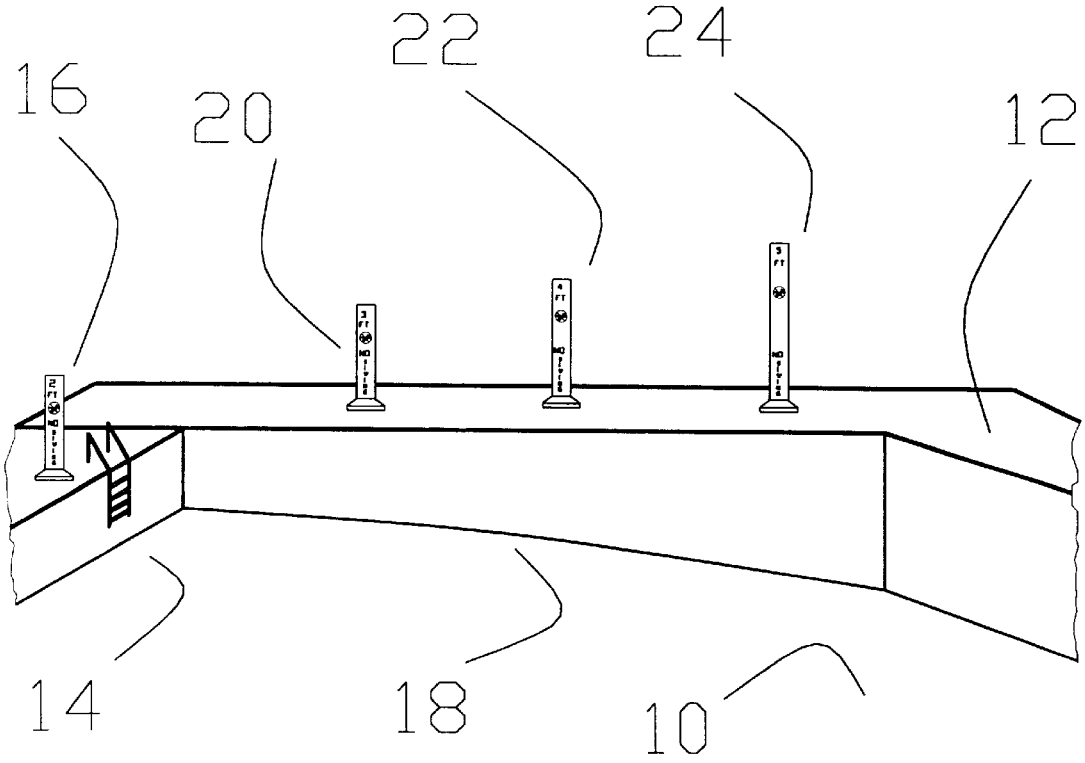
FIG. 1 is a cross-sectional view of the swimming pool with the sign system in place.

Referring now to FIG. 1, there is shown a swimming pool with the sign system installed. The pool 10 has a deck 12 that surrounds it. One end 14 of the pool is shallow and is therefore surrounded by pool depth marking stanchions 16, 20, 22, 24 (hereinafter "stanchion"). The stanchions 16, 20, 22, 24 are spaced apart by a distance that is driven by the industry and is currently 25 feet or each change of 1 foot of depth whichever gives the lesser distance between stanchions. Along the edge 18 where the pool depth is changing it can be seen that the stanchion height also changes. Stanchion 16 is the shortest and indicates the shallowest pool depth, in this case two feet. Stanchion 20 is three feet. Stanchion 22 is one foot taller and stanchion 24 is one foot taller at 5 feet. The result is a stanchion system that provides a visual as well as a written indication of depth.

Figure 2:
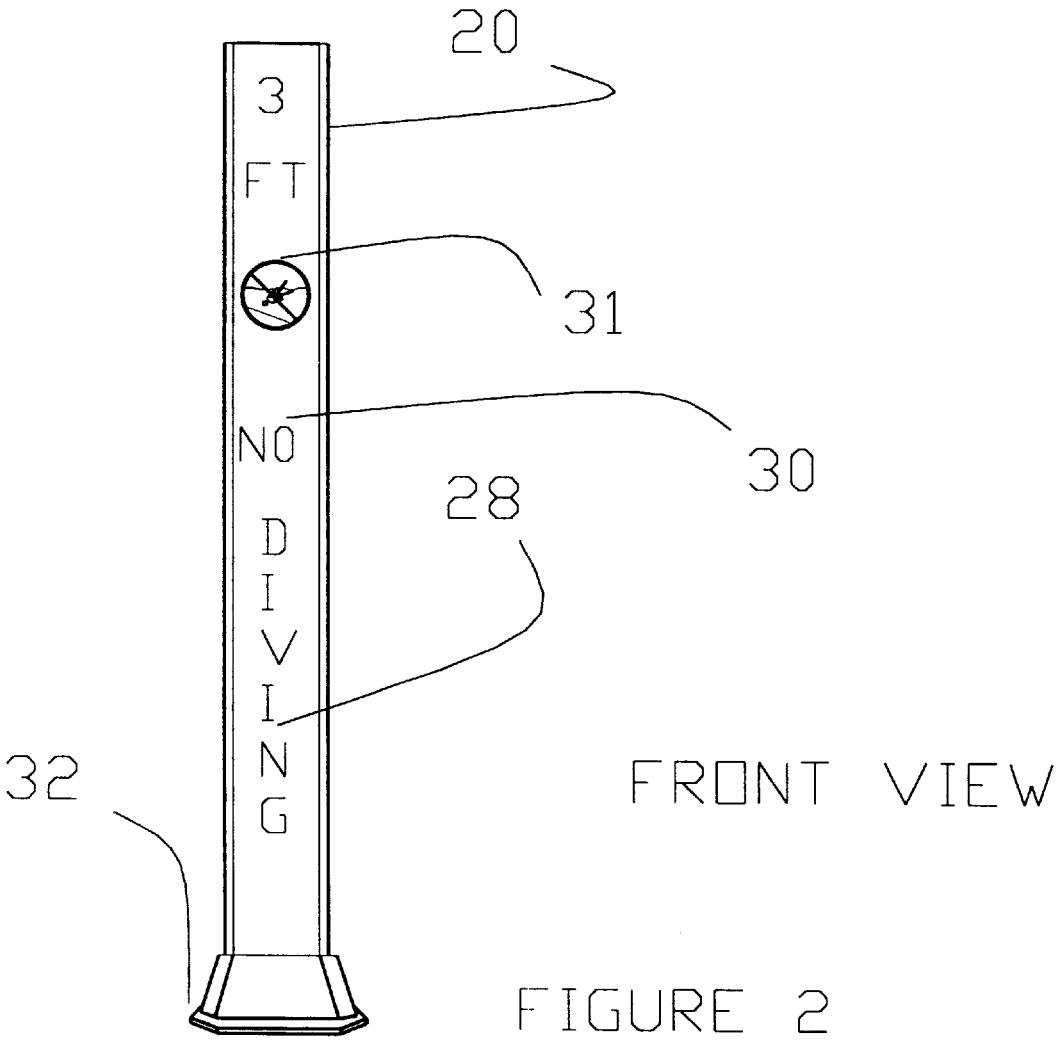
FIG. 2 is a detailed drawing of a single sign.

Referring now to FIG. 2, the detail of a typical stanchion 20 is shown. The base of the stanchion is mounted directly into the deck of the swimming pool. The stanchion 20 can be made of a plastic material that is elastomeric enough to allow the stanchion, when stepped on, to flex to a horizontal position and then to return. The stanchions can also be made of rigid material. The shape of the preferred embodiment is triangular in cross section with each face 28 carrying a depth and/or warning message 30. The warning message 30 will include a universal diving hazard symbol 31.

The base 32 is of a low profile with rounded edges so as to be unobstructive. The base 32 mounts to the pool deck using suitable fasteners 34 such as anchor bolts shown in FIG. 3.

Figure 3:
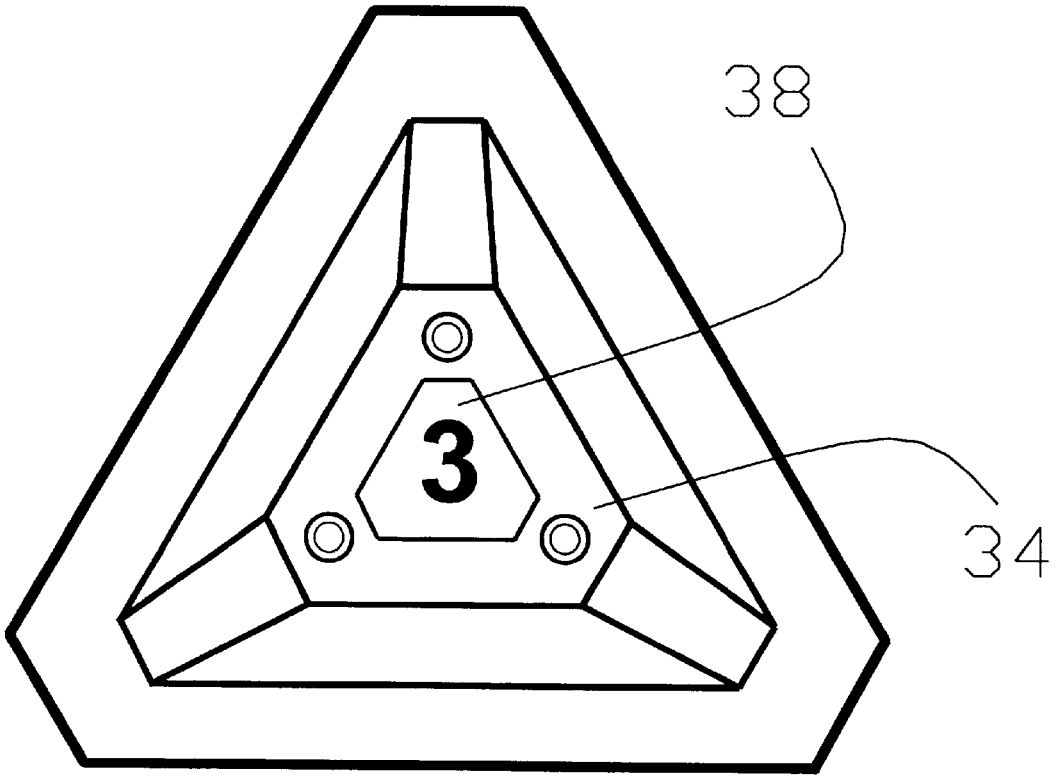
FIG. 3 shows a top view of the sign.

FIG. 3 clearly shows the triangular shape of section 28 which in the preferred embodiment will be an extruded section of flexible U.V. resistant plastic. The triangular shape allows the faces (30) to be visible from any angle or approach to the swimming pool. Also as shown in FIG. 3 a cap (38) that also carries an indication of depth can be included.

Figure 4:
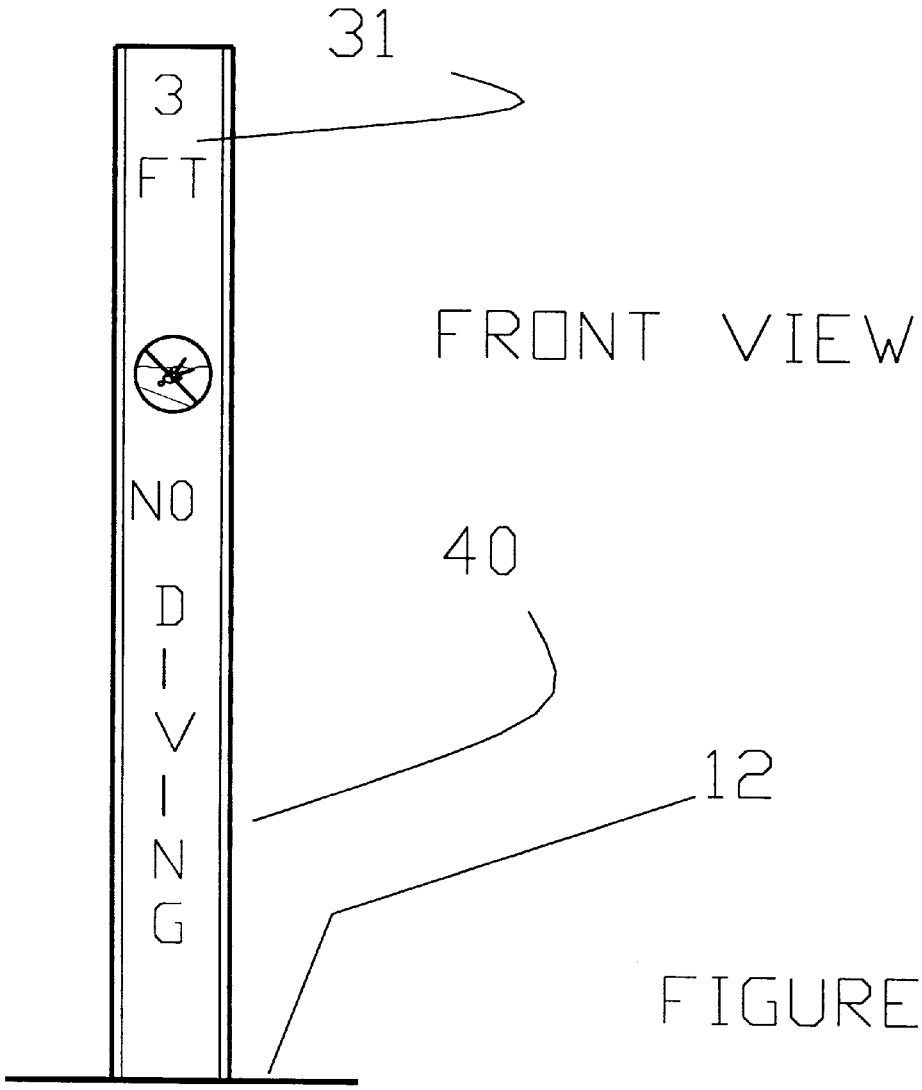
FIG. 4 is a detailed drawing of a second embodiment of the invention.

FIG. 4 shows an alternative embodiment with no base. In this case the main body (40) of a cylindrical stanchion would be cast directly into the concrete of the deck 12. The cross section of stanchion (40) is circular.

Referring to FIG. 1, in operation a person approaching the pool (10) will see a visual depth warning spaced out around the pool. The height of the stanchions 16, 20, 22, 24 will provide a non-written indication of depth. This visual que is important, as it will be easier and more quickly perceived than a written warning. This visual que will be effective in reducing diving accidents which are often caused by an impulsive act.

Because the stanchions are multi sided they can be seen and read from any place in the pool area whether an occupant is in the pool (10) or on the deck 12.

Although shown around a swimming pool the depth warning concept could be used in a similar manner adjacent to other depth hazards such as a dock or pier.

What is claimed is:

1. A warning stanchion in combination with a water depth hazard, said stanchion comprising a vertical post, said post carrying a written warning about the depth of the water hazard and where the height of said vertical post is the same as the depth of said water hazard adjacent to said post.

2. A system of warning stanchions in combination with a water depth hazard, said stanchions comprising a first stanchion adjacent to a shallow portion of said depth hazard, the height of said first stanchion being the same as the depth of said shallow portion of said depth hazard, said stanchions further comprising at least a second stanchion adjacent to a deeper portion of said depth hazard, the height of said second stanchion being the same as the depth of said deeper portion of said depth hazard.

3. The combination of claim 2 wherein said water depth hazard is a swimming pool.

4. The combination of claim 2 wherein said first stanchion and said second stanchion carry a written warning.

5. The combination of claim 2 wherein said stanchions are hollow and triangular in cross section.

6. The combination of claim 2 wherein said stanchions are made of flexible, U.V. resistant material.

* * * * *